US005299522A

United States Patent [19]

Dixon, Jr.

[11] Patent Number: 5,299,522

[45] Date of Patent: Apr. 5, 1994

[54] INFLATABLE ACOUSTIC BUFFER FOR BOAT HULLS

[76] Inventor: Henry R. Dixon, Jr., 1537 Via Romero, Alamo, Calif. 94507

[21] Appl. No.: 28,350

[22] Filed: Mar. 9, 1993

[51] Int. Cl.[5] ..... B63B 59/02

[52] U.S. Cl. ..... 114/220; 114/361

[58] Field of Search ..... 114/219, 220, 240 R, 114/240 A, 240 B, 240 D, 345, 361; 441/41

[56] References Cited

U.S. PATENT DOCUMENTS

| | | | |
|---|---|---|---|
| 1,248,940 | 12/1917 | Smyrski et al. | 114/240 B |
| 1,317,094 | 9/1919 | Moses | 114/240 A |
| 2,444,717 | 7/1948 | Allen | 441/41 |
| 4,520,746 | 6/1985 | Walters et al. | 114/69 |
| 4,598,659 | 7/1986 | Chinnery | 114/39 |
| 4,779,555 | 10/1988 | Hong | 114/345 |
| 4,807,556 | 2/1989 | Hillier | 114/345 |
| 4,838,196 | 6/1989 | Ingram | 114/347 |
| 4,962,719 | 10/1990 | Hughes et al. | 114/343 |
| 4,993,342 | 2/1991 | Eymard | 114/140 |
| 5,006,087 | 4/1991 | Peterson | 441/66 |

FOREIGN PATENT DOCUMENTS

| | | | |
|---|---|---|---|
| 2504881 | 4/1981 | France . | |
| 78694 | 3/1992 | Japan | 114/219 |
| 2113156 | 1/1982 | United Kingdom . | |

*Primary Examiner*—Jesus D. Sotelo
*Attorney, Agent, or Firm*—Francis H. Lewis

[57] ABSTRACT

An acoustic buffer has a pair of inflatable cylinders that float in the water against the hull along the waterline around the bow of a boat to dampen noise of the water lapping against the hull when the boat is anchored. The cylinders are joined together by Velcro strips at the forward ends adjacent to the bow, and each cylinder extends toward the stern along the hull. The aft ends of the cylinders are tied to boat cleats in order to hold the cylinders snug against the hull. Each cylinder has a second inflatable internal cylinder. The inner cylinder is filled with water and the outer cylinder is filled with air by means of valves in the aft ends of the cylinders. The flotation levels of the cylinders may be adjusted by varying the amount of water in the internal cylinders. The buffer may be thereby adjusted to optimally dampen the noise from water lapping against the hull for various different hull designs and shapes. When the anchor is raised and the boat is prepared for traveling, the cylinders are deflated, detached, removed from the water and stored in the boat. Further versions of the invention include a unitary inflatable buffer structure that floats in the water around the bow and in contact with the hull along the waterline.

12 Claims, 3 Drawing Sheets

INFLATABLE ACOUSTIC BUFFER FOR BOAT HULLS

BACKGROUND OF THE INVENTION

This invention pertains generally to the field of boating and marine accessories, and more particularly, to buffers for damping the sound produced in the hull of a boat from the surrounding water.

The motion of the water against the hull of a boat produces a substantial amount of noise within the interior of the boat. Even when a boat is riding at anchor in the water, the lapping of the water against the hull creates sounds of considerable volume inside the boat. This sound is generally most intense below the deck toward the bow of the boat.

This lapping noise is often a problem for pleasure craft that are fitted with sleeping quarters below the deck. V-berths are usually located below deck toward the bow, where the lapping sound is most intense. This makes sleeping on board difficult for many people, particularly those who suffer from insomnia or have trouble sleeping in rooms that are not sufficiently quiet.

The design of conventional pleasure boats does not generally address this problem. It would not be a satisfactory solution to simply manufacture the hull with thick walls, because conventional hull materials such as wood or fiberglass do not have inherent sound absorption properties that are sufficient to make such a design feasible. The required hull thickness in such a design would increase the weight of the craft and reduce the useable space inside the hull to an unsatisfactory degree. Fitting the hull with external sound-deadening structures at the waterline would also be unsuitable, because such structures would degrade the streamline flow and increase the drag of the boat traveling through the water, and thereby adversely affect the speed and handling characteristics of the craft.

SUMMARY OF THE INVENTION

The present invention provides an inflatable buffer structure that may be easily attached to the exterior of the boat hull around the bow at the waterline when the boat is riding at anchor. This structure comprises one or more flexible elongated balloon-like cylinders that fit against the boat hull and absorb the sound of the lapping water, thereby acoustically buffering the hull from this sound. The level at which this structure floats in the water may be adjusted to optimize the acoustical buffering effect. This adjustment can be made by providing a plurality of internal compartments in the cylinders that may be filled with either air or water, so that the weight of the structure and the flotation level may be varied.

The buffer may comprise a unitary elongated flexible structure that extends from one side of the boat around the bow to the other side of the boat, and floats at the waterline against the hull. Alternatively the structure may have a pair of inflated cylinders, one on each side of the boat. One end of each cylinder is removably joined to a corresponding end of the other cylinder, and this joint is located at the bow of the boat when the structure is in place around the hull. The free ends of the cylinders are tied to the hull by lines extending toward the stern, thereby drawing the elongated structure against the hull around the bow of the boat. Valves are provided in the inflatable cylinders for filling or draining the compartments with air or water. When one is preparing to raise anchor and drive the boat, the inflatable structure may be drained and removed from the water, and the cylinders may be detached, folded and stored inside the boat.

It is an object of this invention to provide an acoustic buffer that may be attached to the hull of a boat at the waterline around the bow to absorb the sound of the water lapping against the hull of the boat.

Another object of this invention is to provide an acoustic buffer which may be attached to the hull of a boat and which floats at the waterline around the bow such that the level of such flotation may be adjusted to optimize the degree of acoustic absorption.

A further object of this invention is to provide an acoustic buffer having an inflatable structure which may be removably attached to the hull of a boat and which floats at the waterline around the bow such that when the boat is in motion the structure may be deflated, detached, and stored inside the boat, and when the boat is anchored the structure may be inflated, attached, and positioned in the water around the hull.

Yet another object of this invention is to provide an acoustic buffer which may be removably attached to the hull of a boat and which floats at the waterline around the bow, comprising a pair of inflatable flexible cylinders, removably attached to each other at one end, such that when the boat is in motion the cylinders may be deflated, detached, and stored inside the boat, and when the boat is anchored the cylinders may be inflated, attached, and positioned in the water around the hull.

These and other objects, advantages, characteristics and features of this invention may be better understood by examining the following drawings together with the detailed description of the preferred embodiments.

DESCRIPTION OF THE PREFERRED EMBODIMENTS

Figure 1:
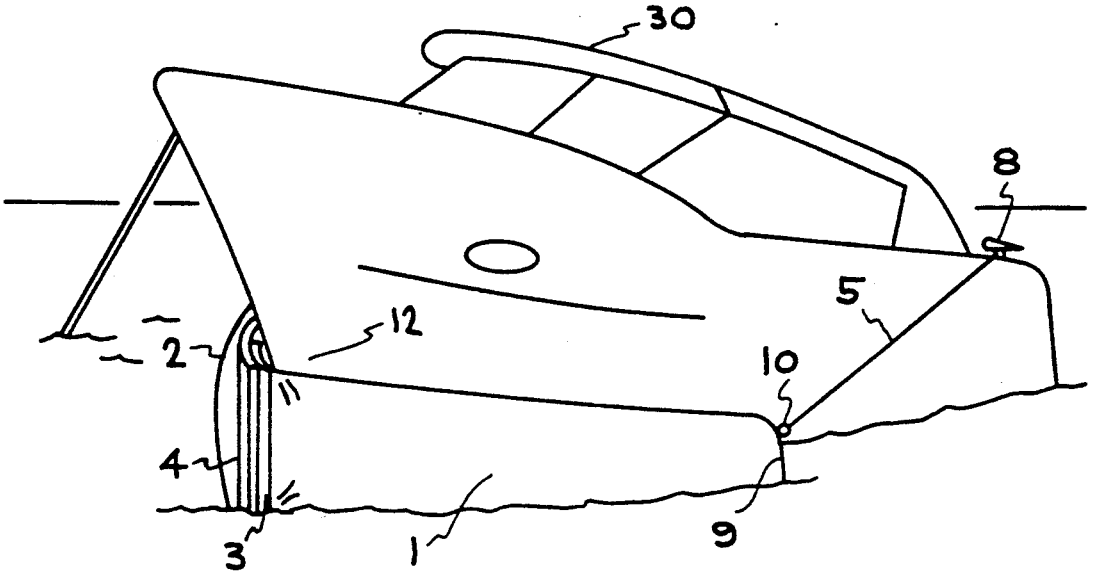
FIG. 1 is an oblique view of a boat riding at anchor, with the acoustic buffer of the present invention positioned around the bow against the hull at the waterline.
Figure 2:
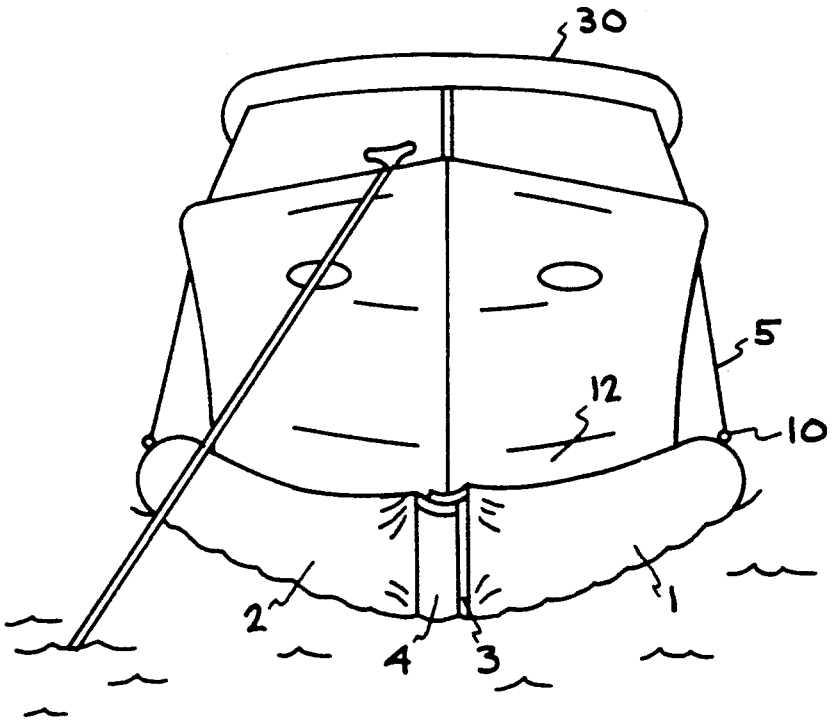
FIG. 2 is a frontal view of the boat in FIG. 1 looking directly toward the bow of the boat.

FIGS. 1 and 2 show a boat 30 riding at anchor with the acoustic buffer of the invention positioned in the water around the bow of the boat against the hull. This buffer is comprised of a flexible inflated cylinder 1 adjacent to the port side of the bow hull 12, and a similar flexible inflated cylinder 2 adjacent to the starboard side of the bow hull. Each of these cylinders floats in the water at a level such that they contact the hull substantially along the waterline, thereby providing an acoustic buffer against the sound of water lapping against the hull. The cylinders may be fabricated typically from 20 gauge @vinyl plastic or other similar material suitable for forming inflatable structures.

Figure 3:
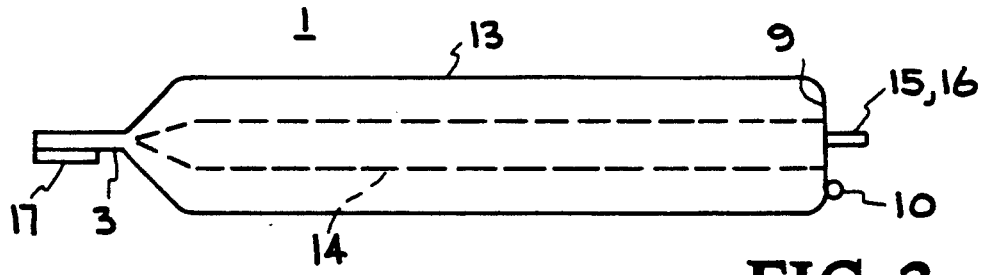
FIG. 3 is a top view of one of the inflated cylinders of the acoustic buffer according to the invention.
Figure 4:
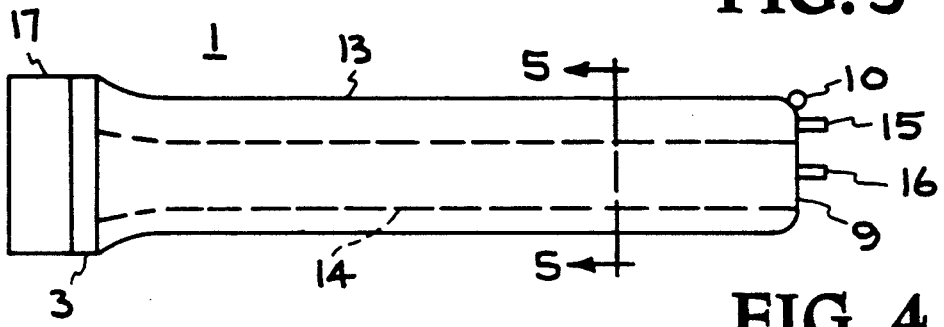
FIG. 4 is a side view of the inflated cylinder shown in FIG. 3.
Figure 6:
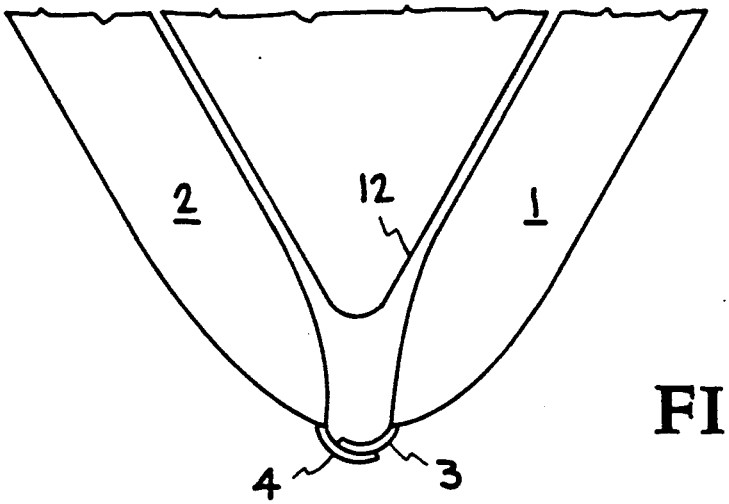
FIG. 6 is a top view of the forward sections of the inflated cylinders of the invention at the ends where they are joined at the bow of the boat, showing also a sectional view of the hull wall at the waterline around the bow adjacent to these sections of the cylinders.

The forward ends of these flexible cylinders are attached to each other, as indicated in FIGS. 1 and 2 and also from a top view in FIG. 6. The forward end 3 of the port side cylinder 1 is compressed in the horizontal direction and sealed to form a vertical seam, which comprises the forward end 3 of the port side cylinder 1. This seal is formed typically by heat sealing the vinyl cylinder material along the seam. Similarly, the forward end 4 of the starboard side cylinder 2 is pinched in the horizontal direction and sealed to form a vertical seam, which comprises the forward end 4 of the starboard side cylinder 2. These two ends, 3 and 4, therefore are in the form of vertical strips, which are removably attached to each other along the length of these strips. Typically this attachment is achieved by affixing patches along these strips 3 and 4 comprised of materials which adhere when pressed together, such as the material commonly sold under the trademark "Velcro". FIGS. 3 and 4 also show the strip 3 having a "Velcro" patch 17 along its length. An alternative embodiment provides zippers along the edges 3 and 4.

Referring still to FIG. 1, the opposite free end 9 of the port side cylinder 1 is secured to the boat 30 by a line 5 that is tied to a cleat 8 on the port side of the boat. This line is attached to the free end 9 by tying it to the fastener loop 10 affixed to the free end 9 of the port side cylinder 1, as shown in FIG. 3.

Figure 9:
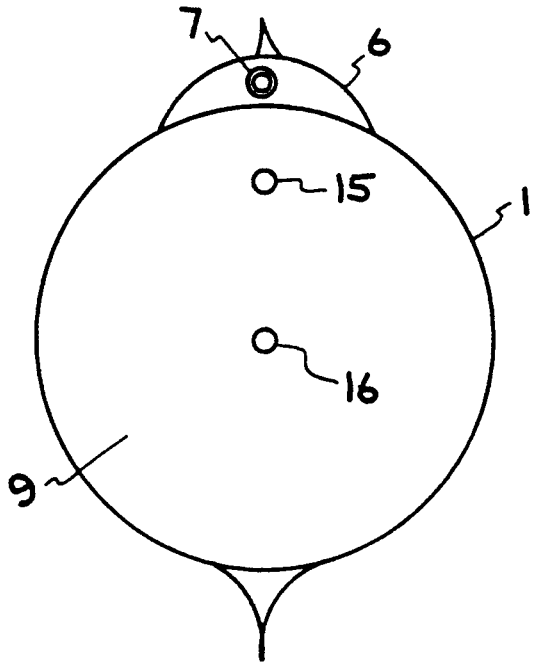
FIG. 9 is an end view of the inflated cylinder shown in FIG. 4, looking toward the stern of the boat.

The use of a fastener loop for this purpose is not unique for this invention. An alternative version of this securing structure is illustrated in FIG. 9, showing the free end 9 of the port side cylinder 1. In this version the end 9 is provided with a fabric tab 6 having a grommet to which the securing line 5 is tied. Similar fastener structures may also be used in place of the fastener loops.

The starboard side cylinder 2 has the same end wall structure as the port side cylinder 1, and is tied by a securing line to a cleat on the starboard side of the boat, not shown in the drawings. By drawing up the securing line 5 around the cleat 8 and the corresponding line around the starboard cleat, the cylinders 1 and 2 may be drawn snug against the boat hull 12.

Figure 5:
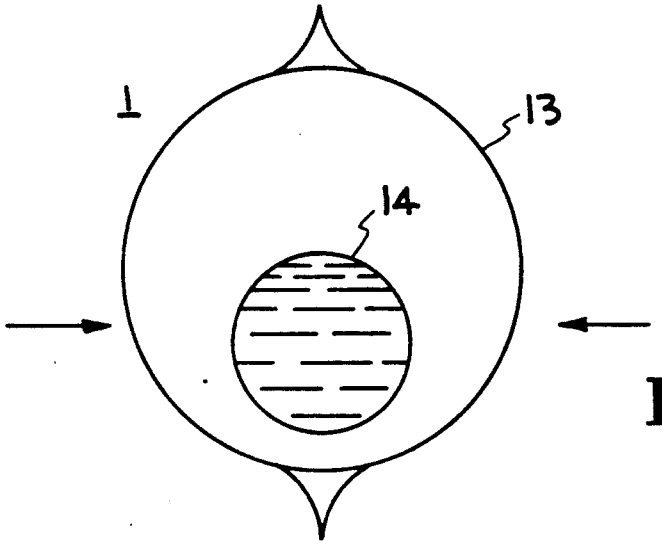
FIG. 5 is an end view of a section of the inflated cylinder shown in FIG. 4, taken along the lines 5—5 indicated in FIG. 4.

Referring now to FIGS. 3 and 4, the port side cylinder 1 has two interior chambers formed by the outer cylinder wall 13 and an interior cylinder wall 14 along the entire length of the cylinder 1. Both the inner cylinder 14 and the outer cylinder 13 share the common end wall 9 and end seam 3. FIG. 5 shows a longitudinal sectional view of the port side cylinder 1 taken along the lines 5—5 of the section defined in FIG. 4. The inner cylinder 14 is disposed about the lateral midplane of the outer cylinder 13, and the elevation of the longitudinal axis of the inner cylinder 14 is below that of the axis of the outer cylinder 13. As indicated in FIG. 5, the inner cylinder 14 is filled with water, and the outer cylinder 13 is inflated with air. The weight of the water-filled inner cylinder 14 causes the port side cylinder 1 to float lower in the water than it would float if the weight of the inner cylinder water were absent. The water line of the floating cylinder 1 is typically at the level shown by the arrows in FIG. 5.

The end wall 9 of the port side cylinder 1 is provided with a valve 15 communicating with the interior of the air chamber defined by the cylinder walls 13 and 14, and also with another valve 16 communicating with the interior of the water chamber defined by the cylinder wall 14. Valves 15 and 16 allow these chambers to be filled or drained with air or water, respectively. These valves may be typically check valves of various designs known to persons skilled in the relevant art.

A modified embodiment of the invention provides two valves in the end wall 9 communicating with the air chamber in place of the single valve 15 shown in FIG. 4; one of these valves is a check valve for inflating the cylinder 1, and the other valve is a release valve for deflating the cylinder 1. A further modification of the invention provides two valves in the end wall 9 of the cylinder 1 communicating with the interior of the water-filled chamber defined by the inner cylinder wall 14. One of these valves is a check valve for filling the inner cylinder 14 with water, and the other valve is a release valve for draining this inner cylinder. The use of separate release valves for the chambers provides additional convenience during use.

The starboard side cylinder 2 is constructed in the same manner as the port side cylinder 1. For a typical pleasure craft, each of these cylinders is approximately 10 feet in length. The outer cylinder wall 13 is typically approximately 10 inches in diameter, and the inner cylinder wall 14 is approximately 6 inches in diameter. The cylinder ends 3 and 4 are strips of typically 3 inches width. The cylinders may be filled and drained by air and water pumps that are carried on board the boat and are connected to the valves 15 and 16 by flexible hoses, not shown in the drawings. Suitable pumps are well known in the relevant art and are readily available in marine supply and sporting goods stores. The inflated air pressure is approximately one atmosphere absolute pressure. The vinyl plastic or other material used to fabricate the cylinders 1 and 2 preferably has a density less than that of water, so that the deflated cylinders can float. When the cylinders 1 and 2 are inflated, the degree of flotation and the level of the waterline shown by the arrows in FIG. 5 may be adjusted by varying the amount of water used to fill the interior cylinder chambers. Furthermore, the cylinders 1 and 2 can be caused to ride lower in the water by instead filling the interior cylinder 14 with air and the outer cylinder 13 with water.

This adjustability of the flotation level is one primary advantage of the present invention. Despite the variability in different boat hull designs, for any given craft the amount of air and water inflation can be adjusted to optimize the flotation level of the cylinders for that particular design, and in this manner the lapping sound can be substantially eliminated from the interior of the hull. It is found that the intensity of the lapping noise is very sensitive to the flotation level, and the buffer functions effectively only when the level is correct.

Another major advantage of this invention lies in the fact that the cylinders may be easily stored inside the boat during travel. When the cylinders are removed from the water, detached from each other, and drained, they may be folded up and compactly stowed. In storage they occupy very little space, and add negligible weight to the boat.

Figure 7:
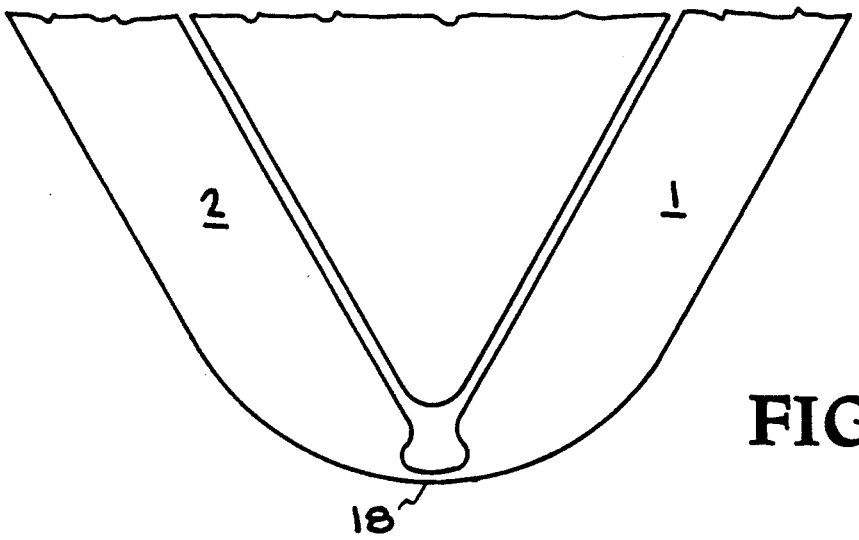
FIG. 7 is a top view of the forward section of an alternative version of the inflated buffer structure around the bow of the boat, showing also a sectional view of the hull wall at the waterline around the bow adjacent to this forward section.

The above description discloses a plurality of removably attachable floating cylinders. This embodiment of the invention is advantageous from the standpoint of storage on the boat because the deflated apparatus is comprised of smaller sections. However the buffer can alternatively be fabricated as a unitary structure, formed by permamently attaching the ends 3 and 4 to form a connecting strip 18 between the two cylinders 1 and 2 at the forward end adjacent to the bow of the boat, as shown in FIG. 7. This embodiment functions in the same manner as the previously described version of the invention, except that when is the deflated cylinders are removed from the water and stowed they remain attached to each other.

Figure 8:
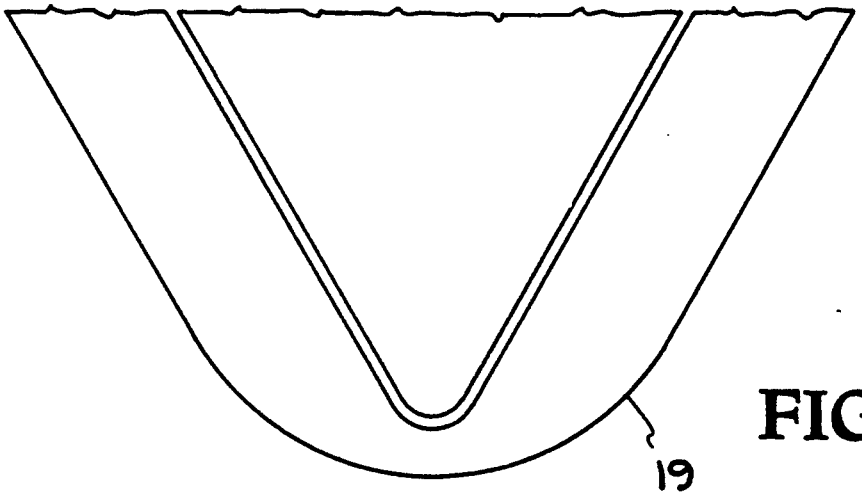
FIG. 8 is a top view of the forward section of another alternative version of the inflated buffer structure around the bow of the boat, showing also a sectional view of the hull wall at the waterline around the bow adjacent to this forward section.

Another version of the invention is illustrated in FIG. 8, wherein the entire buffer is comprised of a single inflatable structure 19 having a "IU-shape" that fits over the bow of the boat. This is also slightly less convenient to handle for storage, and is somewhat more expensive to fabricate; however the overall structure is simpler. These latter two embodiments have the further advantage of eliminating the possibility that the attached cylinders may become detached when the structure is in position in the water.

The foregoing description of the invention has been presented for purposes of illustration and description. It is not intended to be exhaustive or to limit the invention to the precise form disclosed, and obviously many modifications and variations are possible in light of the above teaching. The embodiments are chosen and described in order to best explain the principles of the invention and its practical applications to thereby enable others skilled in the art to best utilize the invention in various embodiments and with various modifications as are suitable to the particular use contemplated. It is intended that the spirit and scope of the invention are to be defined by reference to the claims appended hereto.

What is claimed is:

1. A buffer for damping the sound of water lapping against the hull of a boat, said buffer being adapted for mounting on the hull exterior when the boat is anchored, said buffer comprising:

a first elongated inflatable buffer member made from flexible material, adapted to be inflated and to float in the water adjacent to the port side of the hull from the bow toward the stern along the length of said first member;

a second elongated inflatable buffer member made from flexible material, adapted to be inflated and to float in the water adjacent to the starboard side of the hull from the bow toward the stern along the length of said second member;

said first elongated member and said second elongated member having joining means at one end of each member such that said ends may be removably and flexibly joined, and such that when said members are disposed in the water said joined ends are adapted to float adjacent to the bow of the boat;

said first member having first valve means for enabling said first member to be inflated and deflated;

said second member having second valve means for enabling said second member to be inflated and deflated; and securing means for securing said first and second members to the boat when said members are disposed in the water adjacent to the hull, and for holding said members in position along the hull;

wherein said joining means comprises:

a first adhering material attached to one end of said first member; and a second adhering material attached to one end of said second member;

such that said first and second adhering materials will adhere when pressed together.

2. A buffer for damping the sound of water lapping against the hull of a boat, said buffer being adapted for mounting on the hull exterior when the boat is anchored, said buffer comprising:

a first elongated inflatable buffer member made from flexible material, adapted to be inflated and to float in the water adjacent to the port side of the hull from the bow toward the stern along the length of said first member;

a second elongated inflatable buffer member made from flexible material, adapted to be inflated and to float in the water adjacent to the starboard side of the hull from the bow toward the stern along the length of said second member;

said first elongated member and said second elongated member having joining means at one end of each member such that said ends may be removably and flexibly joined, and such that when said members are disposed in the water said joined ends are adapted to float adjacent to the bow of the boat;

said first member having first valve means for enabling said first member to be inflated and deflated;

said second member having second valve means for enabling said second member to be inflated and deflated; and securing means for securing said first and second members to the boat when said members are disposed in the water adjacent to the hull, and for holding said members in position along the hull;

wherein said joining means comprises a zipper having parts mounted on one end of each of said members for attaching said ends together.

3. A buffer for damping the sound of water lapping against the hull of a boat, said buffer being adapted for mounting on the hull exterior when the boat is anchored, said buffer comprising:

a first elongated inflatable buffer member made from flexible material, adapted to be inflated and to float in the water adjacent to the port side of the hull from the bow toward the stern along the length of said first member;

a second elongated inflatable buffer member made from flexible material, adapted to be inflated and to float in the water adjacent to the starboard side of the hull from the bow toward the stern along the length of said second member;

said first elongated member and said second elongated member having joining means at one end of each member such that said ends may be removably and flexibly joined, and such that when said members are disposed in the water said joined ends are adapted to float adjacent to the bow of the boat;

said first member having first valve means for enabling said first member to be inflated and deflated;

said second member having second valve means for enabling said second member to be inflated and deflated; and securing means for securing said first and second members to the boat when said members are disposed in the water adjacent to the hull, and for holding said member sin position along the hull;

wherein each of said first and second members comprises:

an outer inflatable member, substantially cylindrical in shape when inflated; and an inner inflatable member, substantially cylindrical in shape when inflated, and disposed inside said outer member;

and wherein each of said first and second valve means comprises:

inner valve means for enabling said inner member to be inflated and deflated with air or water; and outer valve means for enabling said outer member to be inflated and deflated with air or water.

4. A buffer as recited in claim 3, wherein said inner valve means comprises a check valve.

5. A buffer as recited in claim 3, wherein said outer valve means comprises a check valve.

6. A buffer as recited in claim 3, wherein said inner valve means comprises a check valve and a release valve.

7. A buffer as recited in claim 3, wherein said outer valve means comprises a check valve and a release valve.

8. A buffer for damping the sound of water lapping against the hull of a boat, said buffer being adapted for mounting on the hull exterior when the boat is anchored, said buffer comprising:

a first elongated inflatable buffer member made from flexible material, adapted to be inflated and to float in the water adjacent to the port side of the hull from the bow toward the stern along the length of said first member;

a second elongated inflatable buffer member made from flexible material, adapted to be inflated and to float in the water adjacent to the starboard side of the hull from the bow toward the stern along the length of said second member;

said first elongated member and said second elongated member having joining means at one end of each member such that said ends may be removably and flexibly joined, and such that when said members are disposed in the water said joined ends are adapted to float adjacent to the bow of the boat;

said first member having first valve means for enabling said first member to be inflated and deflated;

said second member having second valve means for enabling said second member to be inflated and deflated; and securing means for securing said first and second members to the boat when said members are disposed in the water adjacent to the hull, and for holding said members in position along the hull;

wherein said member comprises:

an outer inflatable member, substantially cylindrical in shape when inflated; and an inner inflatable member, substantially cylindrical in shape when inflated, and disposed inside said outer member;

and wherein said valve means comprises;

inner valve means for enabling said inner member to be inflated and deflated with air or water; and outer valve means for enabling said outer member to be inflated and deflated with air or water.

9. A buffer as recited in claim 8, wherein said inner valve means comprises a check valve.

10. A buffer as recited in claim 8, wherein said outer valve means comprises a check valve.

11. A buffer as recited in claim 8, wherein said inner valve means comprises a check valve and a release valve.

12. A buffer as recited in claim 8, wherein said outer valve means comprises a check valve and a release valve.

* * * * *